US008282414B2

(12) United States Patent
Zhou et al.

(10) Patent No.: US 8,282,414 B2
(45) Date of Patent: Oct. 9, 2012

(54) CABLE CONNECTOR ASSEMBLY

(75) Inventors: Yi Zhou, Shenzhen (CN); Xian-Kui Shi, Shenzhen (CN); Chung-Yen Yang, New Taipei (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 13/429,693

(22) Filed: Mar. 26, 2012

(65) Prior Publication Data

US 2012/0184153 A1 Jul. 19, 2012

Related U.S. Application Data

(63) Continuation of application No. 12/829,407, filed on Jul. 2, 2010, now Pat. No. 8,157,584.

(30) Foreign Application Priority Data

Jul. 2, 2009 (CN) ..... 2009 2 0305560 U

(51) Int. Cl.
*H01R 13/66* (2006.01)

(52) U.S. Cl. ..... 439/541.5; 439/607.58

(58) Field of Classification Search ..... 439/541.5, 439/607.58

See application file for complete search history.

(56) References Cited

U.S. PATENT DOCUMENTS

| | | | | |
|---|---|---|---|---|
| 7,118,414 | B2 | 10/2006 | Northstar | |
| 7,200,002 | B2 * | 4/2007 | Peng et al. | 361/679.4 |
| 7,315,444 | B2 | 1/2008 | Northstar | |
| 7,503,802 | B2 | 3/2009 | Tu et al. | |
| 8,011,961 | B2 * | 9/2011 | Liu et al. | 439/607.58 |

FOREIGN PATENT DOCUMENTS

| | | |
|---|---|---|
| TW | M346200 | 12/2008 |

* cited by examiner

*Primary Examiner* — Truc Nguyen

(74) *Attorney, Agent, or Firm* — Ming Chieh Chang; Wei Te Chung

(57) ABSTRACT

A cable connector assembly (100) comprises: an insulative housing (1); a number of first and second types of connectors (21, 22) disposed in the insulative housing. Each of the first type connectors (21) is arranged in an upstanding manner. Two second type of connectors (22) are arranged along a vertical direction and perpendicular to each other to form two mating ports (26) for mating with two complementary connectors simultaneously. A metallic shell (4) surrounds and engages the insulative housing. And a number of cables (3) extend into the insulative housing and electrically connect with the first and second types of connectors.

15 Claims, 5 Drawing Sheets

CABLE CONNECTOR ASSEMBLY

This application is a continuation application of application Ser. No. 12/829,407 filed on Jul. 2, 2009.

BACKGROUND OF THE INVENTION

1. Field of the Invention

The present invention relates to cable connector assembly, more particularly to cable connector assembly with a small volume.

2. Description of Related Art

Nowadays, a plurality of connectors, such as Universal Serial Bus (USB) connector, Audio jack, Print ports, are set in computers for transmitting data signals. In general, the connectors are arranged at a rear side of the computers for preventing a mating connector from being hit and departed from the connectors, and consumers must turn the computer to front for inserting the mating connector and return the computer when the connectors are inserted completely, which is inconvenient to consumers when some connectors are inserted frequently.

For solving the above problems, some computer designers design a computer with some connectors which are used frequently, such as Universal Serial Bus (USB) connectors and Audio jacks, at a front side thereof. And, with a miniature development of the electrical industry, the computer has a small room with a limited width and height to receiving a front I/O connector. So, a plurality of USB connectors and Audio jacks formed in the front I/O connectors are needed to be arranged rationally to take full advantage of the small room. TW Pat. No. M346200 issued on Dec. 1, 2008 discloses a front I/O connector having a housing, and two stacked Audio jacks and two stacked USB connectors received into the housing. The front I/O connector further comprises a retainer disposed in the housing and spaced apart two USB connectors and two Audio jacks to meet a proper distance between two Audio jacks. However, an assembling process of the front I/O is more complicated due to the retainer. And, a manufacturing cost of the front I/O is also increased due to the retainer.

Hence, an improved cable connector assembly with small room and a simple structure is desired to overcome the above problems.

BRIEF SUMMARY OF THE INVENTION

According to one aspect of the present invention, a cable connector assembly comprises: A cable connector assembly comprising: an insulative housing comprises a lower housing and an upper housing engaged with each other along an up to down direction; a plurality of first type of connectors disposed in the insulative housing and paralleled with each other along a transversal direction, each of the first type of connectors arranged in an upright direction; two second type of connectors disposed in the insulative housing and located adjacent to the plurality of first type of connectors, the two second type of connectors arranged along a vertical direction and perpendicular to each other to form two mating ports for mating with two complementary connectors simultaneously; a metallic shell surrounding the insulative housing and engaged with the insulative housing; and a plurality of cables extending into the insulative housing and electrically connected with the first and second type connectors.

According to another aspect of the present invention, a cable connector assembly comprises: an insulative housing formed by a lower housing and an upper housing, the insulative housing defining a plurality of rectangular receiving rooms and a T-shaped receiving room extending rearwardly form a front surface of the insulative housing, the plurality of rectangular receiving rooms arranged along a transversal direction and spaced apart with each other, the T-shaped receiving room located on a lateral side of the plurality of rectangular receiving rooms; a plurality of first type of connectors received into corresponding rectangular receiving rooms; two second type of connectors received into the T-shaped receiving room and perpendicular with each other; a plurality of cables electrically connecting with the first and second type of connectors; and a metallic shell enclosing the insulative housing.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
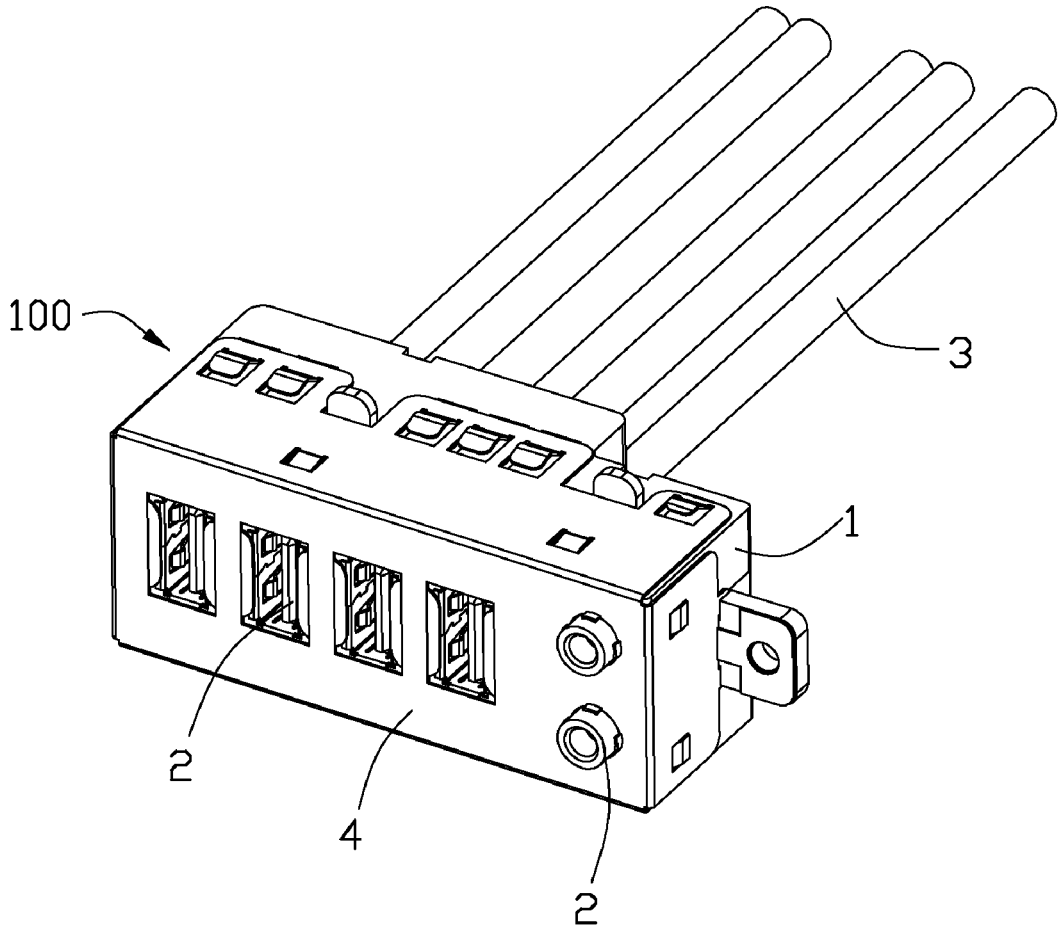
FIG. 1 is a perspective view of a cable connector assembly according to the present invention.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Reference will be made to the drawing figures to describe the present invention in detail, wherein depicted elements are not necessarily shown to scale and wherein like or similar elements are designated by same or similar reference numeral through the several views and same or similar terminology.

Figure 2:
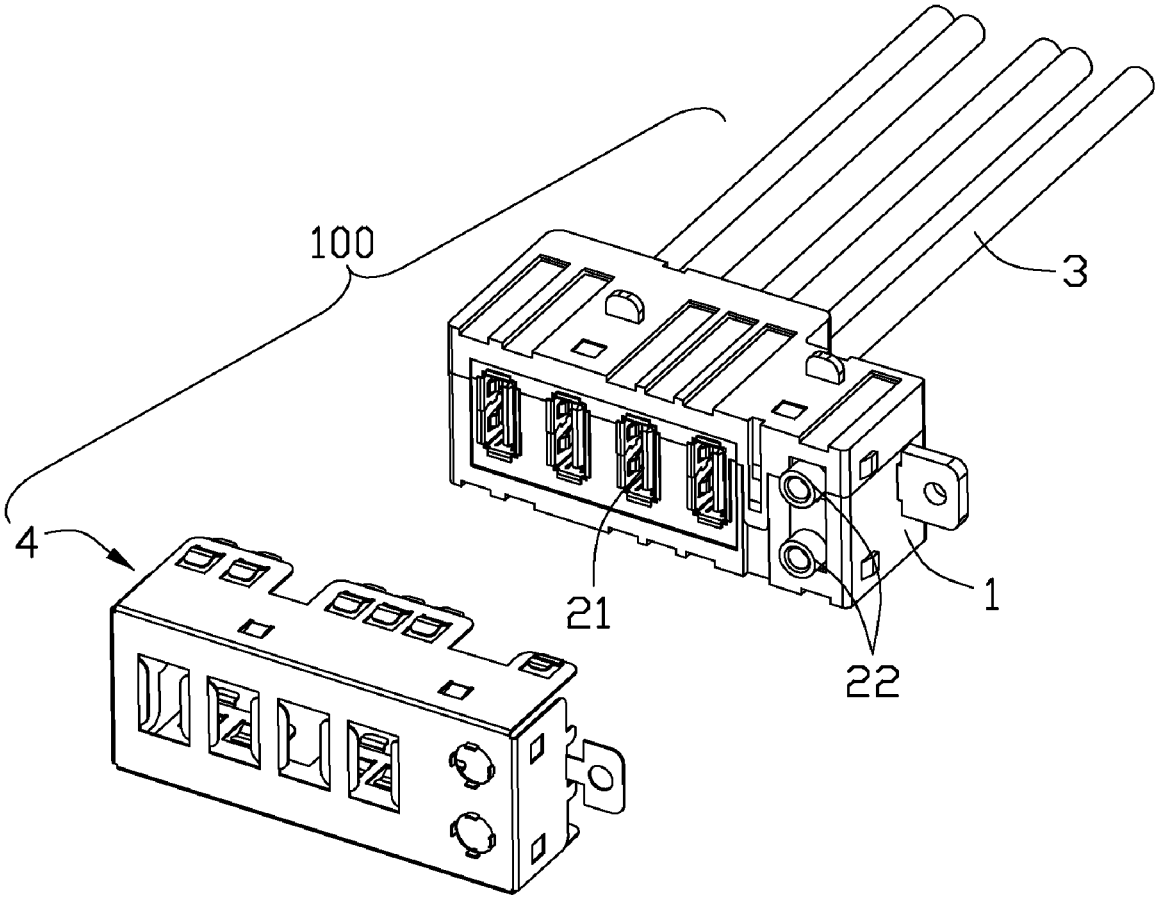
FIG. 2 is a partially perspective view of the cable connector assembly with a metal shell being separated therefrom.
Figure 3:
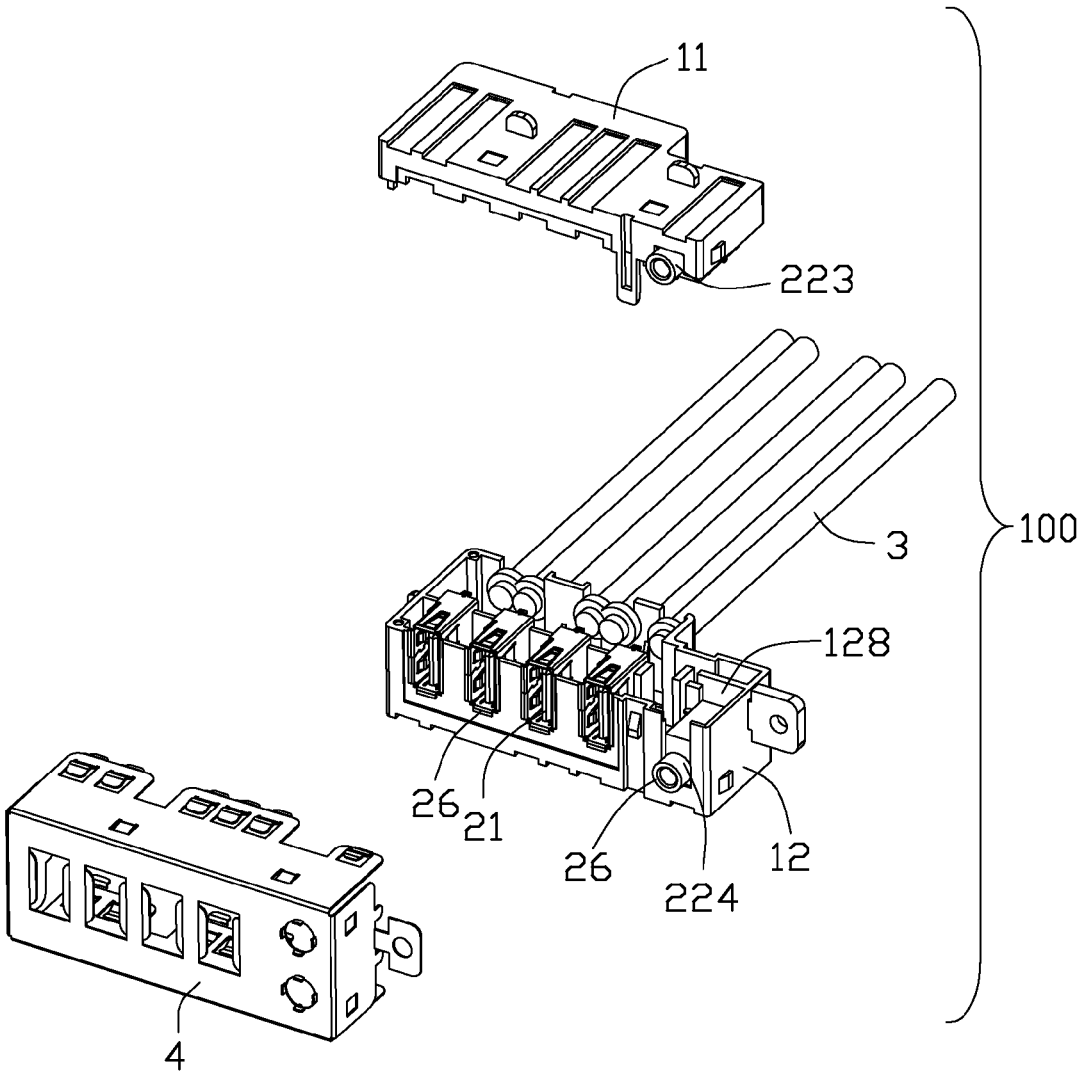
FIG. 3 is a partially perspective view of the cable connector assembly with the metal shell and an upper housing being separated therefrom.
Figure 4:
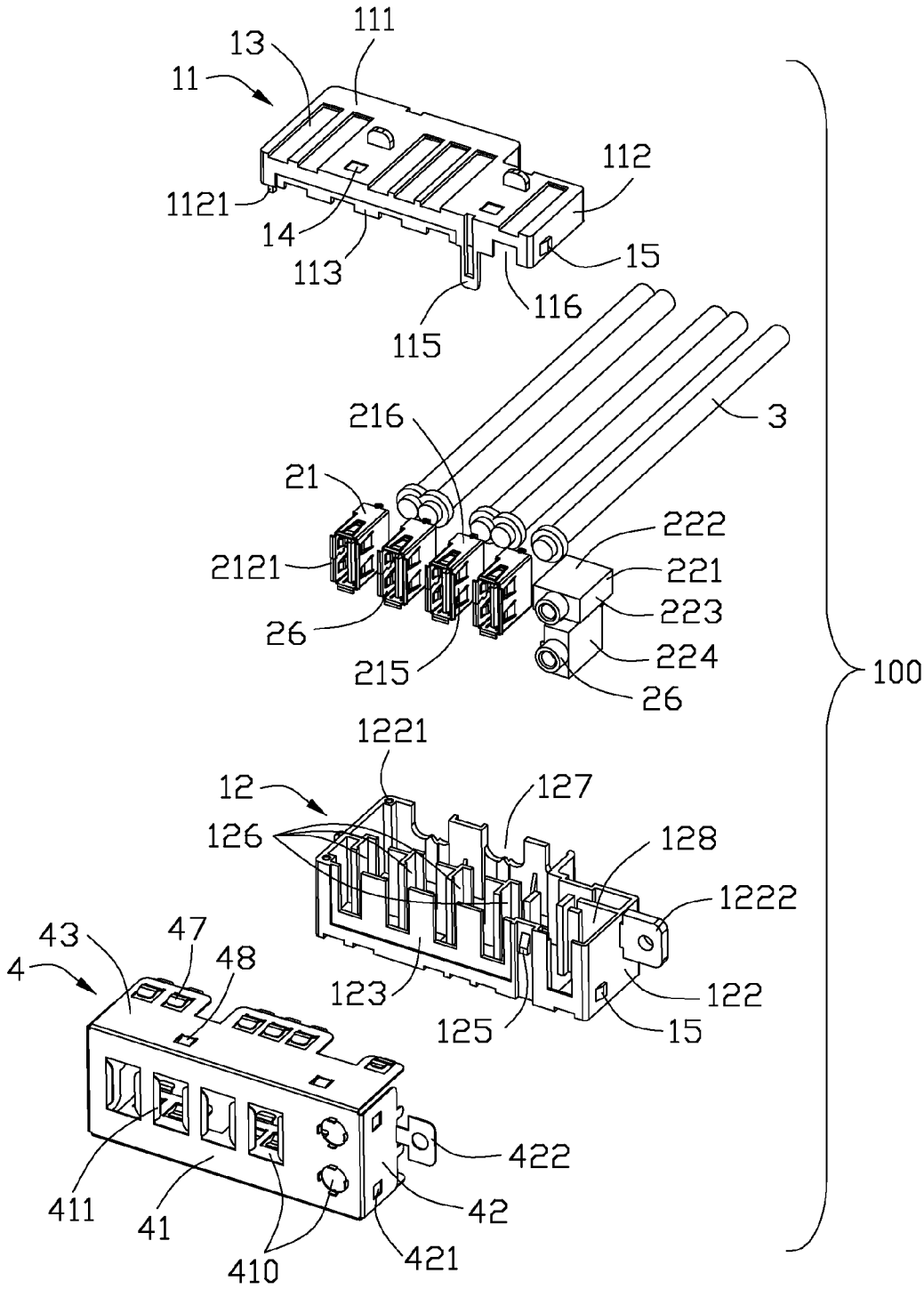
FIG. 4 is an exploded view of the cable connector assembly.
Figure 5:
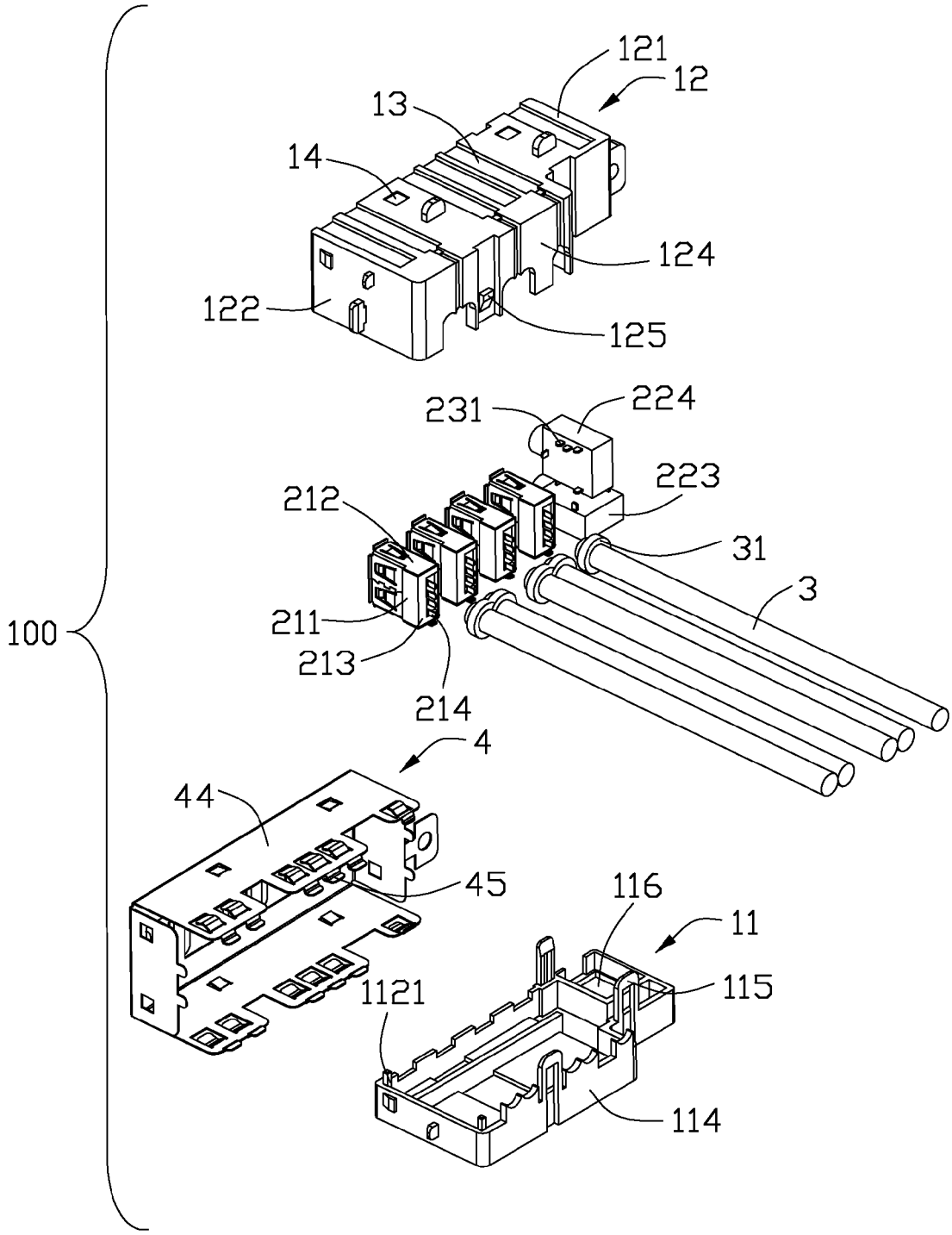
FIG. 5 is a view similar to FIG. 4, while taken from a different aspect.

Referring to FIGS. 1-5, a cable connector assembly 100 according to the present invention comprises an insulative housing 1, a plurality of connectors 2 retained in the insulative housing 1, a plurality of cables 3 connected with the connectors 2 and an outer shell 4 covering the insulative housing 1.

The insulative housing 1 consists of an upper housing 11 and a lower housing 12 retained with each other along an up to down direction. The upper housing 11 has a top wall 111, a pair of first side walls 112 at two sides thereof, and a first front wall 113 and a first rear wall 114 at front and rear sides thereof respectively. The lower housing 12 has a bottom wall 121, a pair of second side walls 122 at two sides thereof and corresponding to the first side walls 112 along the up to down direction, and a second front wall 123 and a second rear wall 124 at front and rear sides thereof and aligned to the first front wall 113 and the first rear wall 112 along the up to down direction respectively. The upper housing 11 is structured in an upper cover.

The lower housing 12 defines a left part and a right part adjacent to each other along the transverse direction. The left part defines a plurality of first cavities 126 opening upwardly and forwardly, and a plurality of openings 127 at the second rear wall 124 for retaining the cables 3. The first cavities 126 are arranged in a row along a transverse direction of the insulative housing 1. The openings 127 communicate with the first cavities 126 along the front to back direction thereof. The right part defines a second cavity 128 opening upwardly and forwardly. The upper housing 11 defines a third cavity 116 opening downwardly and forwardly. The third cavity 116 is aligned to the second cavity 128 and communicates with the second cavity 128 along the up to down direction. Thus, a T-shaped receiving room, defined by the third cavity 116 at an upper part and the second cavity 128 at a lower part, is formed in the insulative housing 1 when the upper housing 11 and the lower housing 12 are engaged with each other and such room extends rearwardly from a front surface of the insulative housing 1. A plurality of rectangular receiving rooms are also formed in the housing 1 when the upper housing 11 and the lower housing 12 are engaged with each other and also extends rearwardly from the front surface of the insulative housing 1. A width of the rectangular receiving room is shorter than a height of the rectangular receiving room. The lower housing 12 can be also defined as a lower base or a lower cover.

The top wall 111 and bottom wall 121 each define a plurality of slots 13 extending along a front to back direction and arranged in a row along a transverse direction of the insulative housing 1, and a pair of recesses 14 between the slots 13. The first front wall 113 and the first rear wall 114 are formed with a plurality of latches 115 extending downwardly from a lower end thereof. The second front wall 123 and the second rear wall 124 are formed with a plurality of projections 125 to lock with the latches 115. The first side walls 112 and the second side walls 122 has a plurality of protrusions 15 extending outwardly to lock with the outer shell 4. One of the first side wall 112 has a pair of posts 1121 extending downwardly from a lower end thereof. One of the second side wall 122 defines a pair of holes 1221 to engage with the posts 1121, and another second side wall 122 is formed with an ear portion 1222 extending outwardly to lock with the outer shell 4.

Referring to FIGS. 1-5, the connectors 2 comprise four USB connectors 21 and two Audio jacks 22. Each connector 2 has a mating end 26 forwardly extending out of the first cavity 126 and a connecting end connecting with the cable 3. Each USB connector 21 has a contact module 211 and an inner shell 212 covering the contact module 211. Each inner shell 212 has a plurality of flanges 2121 extending outwardly from a front end thereof. The contact module 211 comprises a housing 213 and a plurality of contacts 214 retained in the housing 213 and extending out of the housing 213 to electrically connect with the cable 3. Each USB connector 21 has a pair of first side surfaces 215 parallel to a tongue thereof and a pair of second side surfaces 216 between the first side surfaces 215. The second side surfaces 216 are narrower than the first side surface 211. All the USB connectors 21 are downwardly assembled into the first cavities 126 from a top end of the lower housing 12, and uprightly retained in the first cavities 126. Thereby the first side surfaces 215 are parallel to the side walls 112, 122, and the second side surfaces 216 are parallel to the bottom wall 121 for making the four USB connectors 21 occupy a small area of the bottom wall 121, which can decrease a width of the cable connector assembly 100.

The Audio jacks 22 are flat for decreasing a height thereof and manufacture material. The Audio jacks 22 are stacked with each other along the up to down direction, thereby the Audio jacks 22 comprise an upper Audio jack 223 and a lower Audio Jack 224. Each Audio jack 22 has a pair of third side surfaces 221 and a pair of fourth side surfaces 222 between the third side surfaces 221. The fourth side surfaces 222 are narrower than the third side surfaces 221. The lower Audio jack 224 is downwardly assembled into the second cavity 128 from the top end of the lower housing 12 and uprightly retained in the second cavity 128. The third side surfaces 221 of the lower Audio jack 224 are parallel to the side walls 112, 122, and the fourth side surfaces 222 of the lower Audio jack 224 are parallel to the bottom wall 121 for decreasing the width of the cable connector assembly 100. Thereby the USB connectors 21 are parallel to the lower Audio jack 224.

The upper Audio jack 223 is upwardly assembled into the third cavity 116 from a lower end of the upper housing 11 and horizontally retained in the third cavity 116. The third side surfaces 221 of the upper Audio jack 223 are parallel to the top wall 111, and the fourth side surfaces 222 are parallel to the side walls 112, 122. Then when the upper housing 11 and lower housing 12 are retained with each other, the upper Audio jack 223 is perpendicular to the lower Audio jack 224 and presses a top end of the lower Audio jack 224 for preventing the lower Audio jack 224 from moving upwardly, besides, a distance between the mating ends 26 of the two Audio jacks 22 can be increased for simultaneously inserting two Audio plugs (not shown) into the mating ends 26. The mating ends 26 of the two Audio jacks 22 are aligned with each other along the up to down direction. In addition, a front surface of the upper Audio jack 223 is located at a rear side of a front surface of the lower Audio jack 224, and the mating ends 26 of the Audio jacks 22 extend from the front surface thereof. Finally, the insulative housing 1 just comprises the upper and lower housings 11, 12 to retain the connectors 2 together, which make the cable connector assembly 100 of the present invention has a simple structure and be assembled conveniently.

The cable 3 has a retaining portion 31 protruding outwardly at a front side thereof. The retaining portion 31 locks with an inner side of the second rear wall 124 for preventing the cable 3 from being pulled to be separated from the insulative housing 1. Each cable 3 has a plurality of wires (not shown) therein for electrically connecting with the contacts 214.

The outer shell 4 is stamped by a metal sheet. The outer metal shell 4 has a front wall 41 covering a front side of the insulative housing 1, a pair of side walls 42 extending backwardly from two sides of the front wall 41, and an upper wall 43 and a lower wall 44 extending backwardly from upper and lower ends of the front wall 41. The front wall 41 defines a plurality of hollows 410 extending therethrough and corresponding to the cavities 126, 128, 116, and a plurality of tabs 411 extending backwardly from an inner edge of the hollows 410 to contact with the flanges 2121 and the mating ends 26 of the Audio jacks 22 for grounding. The upper and lower walls 43, 44 are formed with a plurality of retaining strips 45 at a rear end thereof to engage with a rear end of the slots 13 of the insulative housing 1, a plurality of springs 47 extending outwardly to engage with a shell of computer (not shown), and two pairs of barbs 48 extending inwardly to engage with the recesses 14. The side walls 42 defines a plurality of locking holes 421 extending therethrough to lock with the projections 125 of the insulative housing 1. The outer shell 4 has a metal ear 422 extending outwardly from a rear end of one side wall 42 to joint with the ear portion 1222 of the insulative housing 1.

As fully described above, the USB connectors 21 and the flat lower Audio jack 224 are slim and uprightly retained in the insulative housing 1, therefore, the cable connector assembly 100 of the present invention has a small width and merely occupies a small area of the computer along a transverse direction thereof. Besides, the flat upper Audio jack 223 is perpendicular to the flat lower Audio jack 224, which make the distance between two front mating ends 26 of the two Audio jacks 22 be increased for simultaneously inserting two Audio plugs (not shown) into the mating ends 26. Two mating ends 26 of the two Audio jacks 22 are arranged in a line along a vertical direction. In addition, the insulative housing 1 in the present invention consists of the upper housing 11 and the lower housing 12, which make the cable connector assembly 100 has a simple structure and is assembled conveniently. Finally, the upper Audio jack 223 is fat and has a small height, which can decrease a height of the cable connector assembly 100.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. A cable connector assembly comprising:

an insulative housing comprises a lower housing and an upper housing engaged with each other along an up to down direction;

a plurality of first type of connectors disposed in the insulative housing and paralleled with each other along a transversal direction, each of the first type of connectors arranged in an upright manner;

two second type of connectors disposed in the insulative housing and located adjacent to the plurality of first type of connectors, the two second type of connectors arranged along a vertical direction and perpendicular to each other to form two mating ports for mating with two complementary connectors simultaneously;

a metallic shell surrounding the insulative housing and engaged with the insulative housing; and a plurality of cables extending into the insulative housing and electrically connected with the first and second type connectors;

wherein each of the first type of connectors is a USB connector, each of the second type of connectors is an audio jack;

wherein the two second type of connectors are stacked with each other and structured in a T-shape;

wherein one second type of connector located on a lower side is arranged in an upright manner and the other second type of connector located on an upper side is arranged in a horizontal direction.

2. The cable connector assembly as claimed in claim 1, wherein the two mating ports are arranged in a line along a vertical direction.

3. The cable connector assembly as claimed in claim 1, wherein the plurality of cables comprise a set of first cables and a second cable, and the second cable is electrically connected with the two second type of connectors and offset from the two second type of connectors along the transversal direction.

4. A cable connector assembly comprising:

an insulative housing formed by a lower housing and an upper housing, the insulative housing defining a plurality of rectangular receiving rooms and a T-shaped receiving room extending rearwardly form a front surface of the insulative housing, the plurality of rectangular receiving rooms arranged along a transversal direction and spaced apart with each other, the T-shaped receiving room located on a lateral side of the plurality of rectangular receiving rooms;

a plurality of first type of connectors received into corresponding rectangular receiving rooms;

two second type of connectors received into the T-shaped receiving room and perpendicular with each other;

a plurality of cables electrically connecting with the first and second type of connectors; and a metallic shell enclosing the insulative housing;

wherein each of the first type of connectors is a USB connector, and each of the second type of connectors is an audio jack;

wherein a vertical distance between two mating ends of the two audio jacks is able to make two audio jacks mated with two audio plugs simultaneously.

5. The cable connector assembly as claimed in claim 4, wherein a width of the rectangular receiving room is shorter than a height of the rectangular receiving room.

6. The cable connector assembly as claimed in claim 4, wherein two mating ends of the two second type of connectors are arranged in a line along a vertical direction.

7. A cable connector assembly comprising:

a housing unit extending along a transverse direction;

a plurality of first cavities side by side located in the housing along said transverse direction, each of said first cavities forwardly communicating with an exterior, via a corresponding first opening, in a front-to-back direction perpendicular to said transverse direction;

a plurality of first connectors received in the corresponding first cavities, respectively, each of the first connectors defining a first long side and a first short side under condition that each of the first connectors is arranged in the housing in an upright manner with the first short side along the transverse direction so as to minimize a total space of said first connectors in the transverse direction;

one second cavity and on third cavity commonly located at a same end of the housing in said transverse direction while generally mutually stacked with each other in a vertical direction perpendicular to both said transverse direction ad said front-to-back direction, the second cavity and the third cavity being communicating forwardly with the exterior via corresponding second and third openings in the front-to-back direction;

a second connector disposed in the second cavity and communicating forwardly with the exterior via a second opening;

a third connector disposed in the third cavity and communicating forwardly with the exterior via a third opening; and the second connector and the third connector being essentially same with each other and each defining a second long side and a second short side; wherein the second connector disposed in the housing with the seocnd long side along the transverse direction while the third connector disposed in the housing with the second short side along the transverse direction so as to have the second connector and the third connector arranged in the housing not only occupying a spared space along the transverse direction but also meeting a predetermined distance between a mating end of the second connector and that of the third connector in the vertical direction under condition that the mating ends of both said second connector and said third connector extend forwardly beyond the corresponding second and third openings and aligned with each other in the vertical direction.

8. The cable connector assembly as claimed in claim 7, wherein a mating end of said first connector is essentially flush with the corresponding first opening.

9. The cable connector assembly as claimed in claim 7, wherein the housing unit defines a cover and a base attached to each other in the vertical direction so as to allow the first, second and third connectors are assembled into the corresponding first, second and third cavities in the vertical direction, respectively.

10. The cable connector assembly as claimed in claim 7, wherein each of said first, second and third connectors is, at a rear end thereof, equipped with a cable extending rearwardly through the housing unit.

11. The cable connector assembly as claimed in claim 10, wherein the cables of said second and third connector extend rearwardly out of the housing right behind the adjacent first connector in the front-to-back direction.

12. The cable connector assembly as claimed in claim 11, wherein the housing defines a stepped structure behind the second and third cavities, and a mounting ear with a through hole therein beside the stepped structure.

13. The cable connector assembly as claimed in claim 7, further including a metallic shell enclosing the housing, wherein said shell defines a plurality of apertures aligned with the corresponding openings of the housing in the front-to-back direction, respectively, and each of said apertures is equipped with a plurality of tiny flanges around a periphery thereof.

14. The cable connector assembly as claimed in claim 7, wherein the second connector and the third connector are intimately stacked with each other without a gap therebetween in the vertical direction.

15. The cable connector assembly as claimed in claim 7, wherein a dimension defined by the mating ends of both the second connector and the third connector in the vertical direction is somewhat larger than a dimension of the mating end of each first connector in the vertical direction.

* * * * *